US010338527B2

(12) United States Patent
Tombez et al.

(10) Patent No.: US 10,338,527 B2
(45) Date of Patent: Jul. 2, 2019

(54) SELF-WINDING WATCH

(71) Applicant: The Swatch Group Research and Development Ltd, Marin (CH)

(72) Inventors: Lionel Tombez, Neuchatel (CH); Jean-Jacques Born, Morges (CH); Michel Willemin, Preles (CH); Pascal Winkler, St-Blaise (CH); Lionel Paratte, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/710,209

(22) Filed: Sep. 20, 2017

(65) Prior Publication Data

US 2018/0088534 A1 Mar. 29, 2018

(30) Foreign Application Priority Data

Sep. 27, 2016 (EP) ..... 16190915.5

(51) Int. Cl.

| | |
|---|---|
| ***G04B 5/08*** | (2006.01) |
| ***G04B 5/16*** | (2006.01) |
| ***G04C 1/06*** | (2006.01) |
| ***G04C 10/02*** | (2006.01) |

(52) U.S. Cl.

CPC ..... *G04B 5/08* (2013.01); *G04C 1/062* (2013.01); *G04C 10/02* (2013.01); *G04B 5/16* (2013.01)

(58) Field of Classification Search

CPC . G04B 7/00; G04C 1/06; G04C 1/062; G04C 1/065; G04C 1/067; G04C 10/02

See application file for complete search history.

(56) References Cited

U.S. PATENT DOCUMENTS

| | | | | |
|---|---|---|---|---|
| 3,724,200 A * | 4/1973 | Donner | ..... | G04C 10/02 368/149 |
| 4,901,295 A | 2/1990 | Taguezout et al. | | |
| 4,939,707 A * | 7/1990 | Nagao | ..... | G04C 10/00 368/204 |
| 6,320,822 B1 * | 11/2001 | Okeya | ..... | G04C 10/00 307/121 |

(Continued)

FOREIGN PATENT DOCUMENTS

| | | | | |
|---|---|---|---|---|
| EP | 0 320 754 A1 | 6/1989 | | |
| JP | 54123068 A * | 9/1979 | ..... | G04C 10/00 |
| WO | WO 2007/095767 A2 | 8/2007 | | |

OTHER PUBLICATIONS

European Search Report dated Mar. 29, 2017 in European Application 16190915.5, filed on Sep. 27, 2016.

*Primary Examiner* — Daniel P Wicklund

(74) *Attorney, Agent, or Firm* — Oblon, McClelland, Maier & Neustadt, L.L.P.

(57) ABSTRACT

A self-winding watch includes a movement connected to a winding device of a barrel spring including an oscillating weight pivoting around an axis A, a reduction wheel train cooperating with the oscillating weight to transmit the torque to the barrel, a storage unit for electrical energy, a photovoltaic cell arranged to receive the ambient light and charge the electrical energy storage unit, a control circuit connected to the terminals of the electrical energy storage unit and a driver connected to the circuit and coupled to the oscillating weight to displace it. The electrical energy storage unit, the control circuit an d the driver are integrated to the oscillating weight.

10 Claims, 1 Drawing Sheet

(56) References Cited

U.S. PATENT DOCUMENTS

| | | | | |
|---|---|---|---|---|
| 7,306,364 | B2 * | 12/2007 | Born | G04B 17/063 368/148 |
| 2001/0005895 | A1 * | 6/2001 | Shimura | G04G 19/08 713/320 |
| 2002/0183865 | A1 * | 12/2002 | Ichikawa | G04C 10/00 700/15 |
| 2007/0252434 | A1 * | 11/2007 | Yang | B60L 8/003 307/9.1 |
| 2009/0129211 | A1 | 5/2009 | Rochat | |
| 2017/0115628 | A1 * | 4/2017 | Marechal | G04B 3/00 |
| 2017/0364038 | A1 * | 12/2017 | Fulda | G04G 19/00 |
| 2018/0181075 | A1 * | 6/2018 | Born | G04D 7/009 |

* cited by examiner

SELF-WINDING WATCH

This application claims priority from European Patent Application No. 16190915.5 filed on Sep. 27, 2016, the entire disclosure of which is hereby incorporated herein by reference.

FIELD OF THE INVENTION

The present invention relates to the technical field of self-winding devices. More specifically, the invention relates to a device that enables a barrel spring of a timepiece, for example, to be wound by means of ambient light energy by a photovoltaic cell.

BACKGROUND OF THE INVENTION

Watch movements require drive means to supply energy to an assembly of mechanisms that serve to give at least one time indication.

In the case of mechanical watches this is a mainspring or barrel spring, which is wound by the action of a manually operated winding mechanism or as a result of the movements of the wearer that are transmitted to the barrel spring via an oscillating weight connected to a reduction wheel train. The invention relates to self-winding clockmaking movements using an oscillating weight.

The oscillating weight can wind the spring using the energy the weight produces either in a single direction of rotation only or in both directions of rotation, depending on which mechanism it is connected to.

Generally, the oscillating weight is mounted to be rotatably guided on a shaft with an unbalance. When this oscillating weight shifts in a first direction of rotation, referred to as winding direction, it drives a transmission wheel train that winds a spring of the barrel. When the weight shifts in the other direction, referred to as free direction, this oscillating weight no longer acts on the transmission wheel train of the spring and is free to rotate. In the absence of movement of the wearer the weight returns to its equilibrium point due to the unbalance after several oscillations allowing it to wind the spring each time it shifted in the winding direction.

Movement of the arm of the wearer of the watch can generate a rotation in one direction of rotation or the other of the weight to recover energy.

Self-winding devices are also known that comprise a motor intended to move the oscillating weight and enable the barrel spring to be wound. Such a device is described in document EP 0 320 754. However, the torque required for winding the spring is quite high and this involves a powerful, and therefore bulkier, motor or an also cumbersome high gear ratio.

SUMMARY OF THE INVENTION

The aim of the invention in particular is to remedy the different disadvantages of these known techniques.

More specifically, an object of the invention is to provide a self-winding device, which enables reduction of the torque required for winding the barrel spring.

Another object of the invention is to wind the watch when it is not worn and thus keep it in operation as well as preserve the function of the oscillating weight when it is worn.

A further object of the invention is to provide a "plug and play" device, wherein the invention allows the oscillating weight of an existing movement to be replaced without major changes.

These objects as well as others that will become clearer subsequently are achieved according to the invention by means of a self-winding watch comprising a movement connected to a winding device of a barrel spring comprising:

- an oscillating weight pivoting around an axis;
- a reduction wheel train cooperating with the oscillating weight to transmit the torque to the barrel;
- a storage unit for electrical energy;
- a photovoltaic cell arranged to receive the ambient light and charge the electrical energy storage unit;
- a control circuit connected to the terminals of said electrical energy storage unit; and
- drive means connected to the circuit and coupled to the oscillating weight to displace it.

According to the invention the electrical energy storage unit, the control circuit and the drive means are preferably integrated in the oscillating weight.

In accordance with other advantageous variants of the invention:

- the drive means comprise at least one micromotor arranged to cooperate with the watch in order to displace the oscillating weight around the axis;
- the drive means comprises a toothed ring integral to the watch that cooperates with the drive means;
- the drive means comprise a transmission shaft that supports a pinion meshing with said toothed ring;
- the toothed ring has a diameter that is identical to or slightly larger than the diameter of the movement;
- the drive means comprise a multipolar wheel arranged to cooperate with the watch in order to displace the oscillating weight around the axis;
- the drive means comprise a toothed ring made from ferromagnetic material that is integral to the watch and cooperates with said multipolar wheel;
- the energy storage unit comprises a supercapacitor, a capacitor, an inductor or a battery;
- the photovoltaic cell is preferably mounted on the visible face of the oscillating weight, but can also be mounted on the other face for a skeleton movement, for example;
- the solar cell is assembled on the watch.

The invention also relates in particular to all timepieces in conformity with the invention.

BRIEF DESCRIPTION OF THE DRAWINGS

Other characteristics and advantages of the invention will become clearer on reading the following description of a particular embodiment of the invention given as non-restrictive illustrative example and of the attached figures, wherein.

DETAILED DESCRIPTION OF PREFERRED EMBODIMENTS

Figure 1:
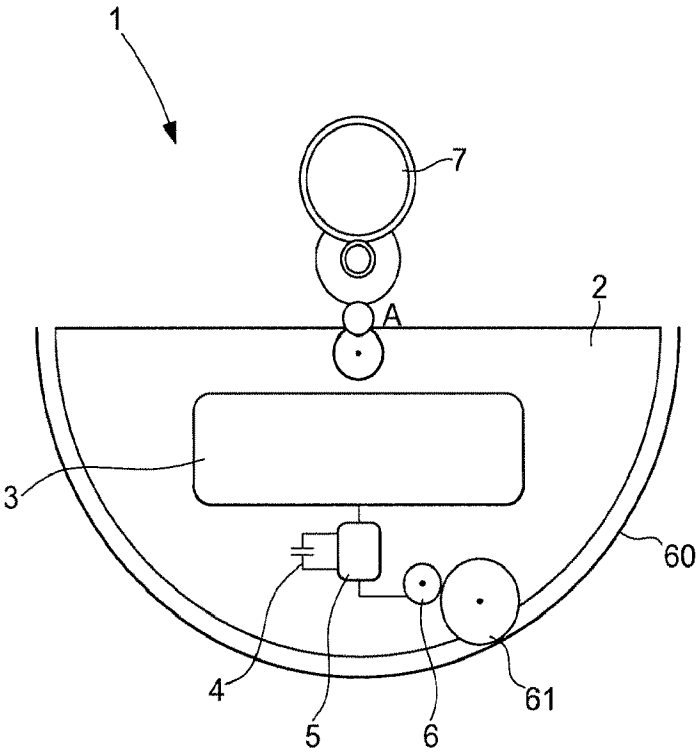
FIG. 1 is a schematic view of a winding device fitted to a watch in conformity with the invention according to a first embodiment.

An embodiment of a watch according to the invention will be described within the framework of a particularly advantageous application shown in FIG. 1. The winding device 1 is connected to a conventional mechanical watch movement, the assembly forming an automatic watch, in which the winding energy is supplied by the ambient light instead of or in addition to being produced by the movements of the arm of the wearer of the watch. Thus, the watch will be wound if it is worn or not for as long as it receives light energy.

The winding device 1 uses a photovoltaic ell 3 to transform the energy from natural or artificial ambient light into electrical energy, and the photovoltaic cell 3 can be arranged on the oscillating weight 2 of the watch so as to receive the light when the watch is not worn or from the dial side when it is worn. A person skilled in the art could also envisage a combination of both. The photovoltaic cell 3 can have several basic cells, e.g. heterojunction type cells, connected in series and/or in parallel to supply current. This current is capable of varying in substantial proportions depending on whether the watch is located in half light or in full sun.

An electrical energy storage unit 4 is connected to the photovoltaic cell 3 in order to store the energy produced by this cell. The electrical energy storage unit 4 can be provided in the form of a rechargeable battery, a supercapacitor or also in the form of a simple ceramic capacitor or an inductor. The photovoltaic cell 2 and the electrical energy storage unit 4 are then connected to the control circuit 5, which at its output supplies drive pulses to the drive means 6.

According to a first embodiment the drive means 6 comprise a brushless-type micromotor or a Lavet type stepping motor well known in the clockmaking industry, or an axial flux motor, for example, or also a piezoelectric type motor, and the micromotor comprises a transmission shaft, at the end of which a pinion 61 is mounted, which is arranged to cooperate with a toothed ring 60, or also a toothed sector formed in the watch or assembled on the latter. In this way, when the micromotor is active, it displaces the oscillating weight 2 around the axis A, which has the effect of winding the barrel spring through a reduction wheel train 7 commonly used in self-winding mechanical watches. The advantage of such a solution is that a much less significant torque is required than in known devices because of the reduction that the wheel train 7 provides.

Figure 2:
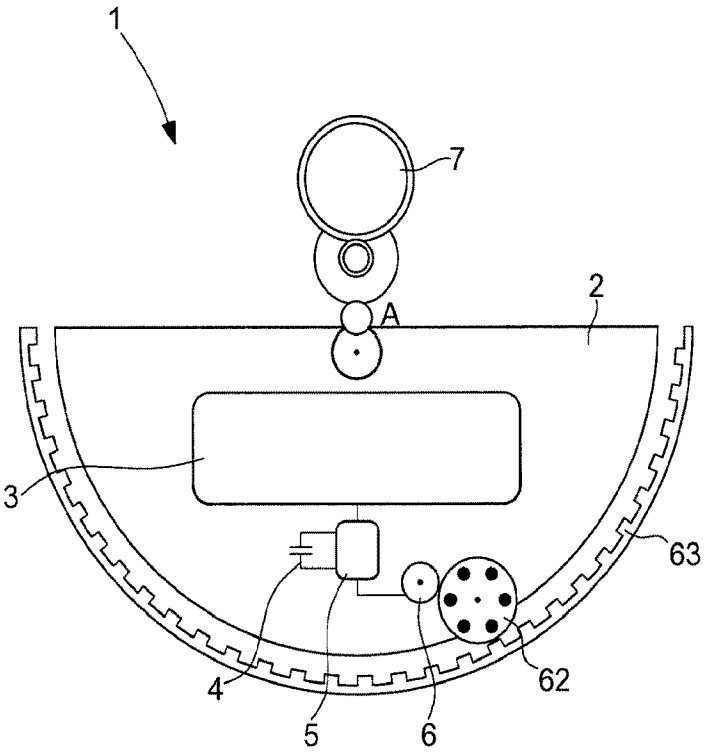
FIG. 2 is a schematic view of a winding device fitted to a watch in conformity with the invention according to a second embodiment.

According to a second embodiment shown in FIG. 2 the drive means 6 comprise a magnetic coupling between a wheel 62 composed of magnets or a magnet in one piece driven by the micromotor and a ferromagnetic notched wheel 63 integral to the watch, wherein the magnets of the wheel 62 are attracted by the notches of the notched wheel 63, and this drives the oscillating weight 2 without there being any contact.

The force of the magnetic coupling is selected so as to drive the oscillating weight 2 up to a certain torque lower than the maximum torque of the barrel spring. This prevents stressing of the spring and allows the oscillating weight 2 to do its winding work while worn. Moreover, the absence of contact means significant stresses can be avoided on the teeth of the gears in the event of impact because of the high inertia of the oscillating weight 2.

Supposing that the photovoltaic cell 3 is illuminated and the electrical energy storage unit 4 is initially discharged, the current supplied by the photovoltaic cell 3 has the effect of charging the electrical storage unit 4 and causing its voltage or current to increase. After a certain time, with the voltage or current at the terminals of the storage unit 4 reaching the value corresponding to a reference value, the circuit 5 acts as a circuit breaker connecting the terminals of the storage unit 4 to the terminals of the drive means 6 during a predetermined time period. The storage unit 4 then supplies a well defined drive pulse to the drive means 6 to cause them to advance one or more steps.

Advantageously, the transmission can be controlled as a function of the position of the watch. In the case where the watch is in a horizontal position or lying flat, the effect of gravity is negligible and the oscillating weight 2 is set in continuous rotation. In the case where the watch is in vertical position or standing on end, the oscillating weight 2 is wound from a certain angle, e.g. 90°, before being released so that the weight 2 oscillates under the effect of gravity until it returns to its equilibrium position. Once the equilibrium position is reached the cycle recommences. As an example, in normal light conditions the micromotor can perform about twenty five steps per second. In general, five barrel turns are sufficient to wind the spring, which corresponds to five hundred turns of the oscillating weight, i.e. two hundred and fifty thousand steps of the micromotor, or also 500 steps per turn of the oscillating weight. Therefore, about three hours will be sufficient to wind the barrel spring.

According to another particular embodiment of the invention the watch has zones that are intentionally shaded in order to periodically deprive the photovoltaic cell 3 of light and thus generate pulses necessary to supply the drive means 6. Such a variant would enable the electronic circuit 5 to be avoided.

According to a variant of the invention the electronic circuit 5 comprises means for measuring the quantity of energy supplied and/or the current profile necessary to supply the motor and/or the number of steps conducted in order to detect the moment or the barrel is completely wound. When this moment has been detected, the electronic circuit 5 ceases sending pulses to the micromotor so as not to abrade the barrel spring.

The watch movement, which is connected to the winding device 1, itself comprises a barrel spring, a wheel train driven by the spring, an oscillator set in oscillation by the wheel train to stabilise the rotation of the different wheels of the movement and a time display controlled by this wheel train. The barrel spring is then coupled to the gear train 7 to be wound at each step performed by the drive means 6. The movement and the winding device thus form the heart of an autonomous automatic watch that only requires sufficient ambient light to function, typically about 150/200 Lux.

According to another variant of the invention the oscillating weight 2 comprises coils to itself form the rotor of a motor. The stator is formed by a ring comprising several magnets, which allows the oscillating weight 2 to itself be displaced without a motor with the electronic circuit 5 supplying the coils to create a magnetic field.

Because of these different aspects of the invention an automatic watch is provided that is autonomous from the energy viewpoint, which indicates the time continuously and does not require any particular action for winding the barrel spring, even when the watch is not worn.

The present invention is, of course, not limited to the illustrated example and is capable of various variants and modifications that will be clear to a person skilled in the art.

What is claimed is:

1. A self-winding watch comprising a movement connected to a winding device of a barrel spring comprising:

an oscillating weight pivoting around an axis A;

a reduction wheel train cooperating with the oscillating weight to transmit the torque to the barrel;

at least one storage unit for electrical energy;

at least one photovoltaic cell arranged to receive the ambient light and charge the electrical energy storage unit;

a control circuit connected to the terminals of the storage unit; and drive means connected to the control circuit and coupled to the oscillating weight to displace the oscillating weight, wherein the energy storage unit, the control circuit and the drive means are integrated in the oscillating weight.

2. The watch according to claim 1, in which the drive means comprise at least one micromotor arranged to cooperate with the watch in order to displace the oscillating weight around the axis A.

3. The watch according to claim 2, in which the drive means comprise a toothed ring integral to the watch that cooperates with said at least one micromotor.

4. The watch according to claim 3, in which said at least one micromotor comprises a transmission shaft that supports a pinion meshing with said toothed ring.

5. The watch according to claim 3, in which said toothed ring has a diameter that is identical to or slightly larger than the diameter of the movement.

6. The watch according to claim 1, in which the drive means comprise a multipolar wheel arranged to cooperate with the watch in order to displace the oscillating weight around the axis A.

7. The watch according to claim 6, in which the drive means comprise a toothed ring made from ferromagnetic material that is integral to the watch and cooperates with said multipolar wheel.

8. The watch according to claim 1, in which the energy storage unit comprises a supercapacitor, a capacitor, an inductor or a battery.

9. The watch according to claim 1, in which the at least one photovoltaic cell is mounted on the oscillating weight.

10. The watch according to claim 1, in which the at least one photovoltaic cell is assembled on the watch.

* * * * *